US012103720B2

(12) United States Patent
Xu

(10) Patent No.: US 12,103,720 B2
(45) Date of Patent: Oct. 1, 2024

(54) BAG SEALING MACHINE

(71) Applicant: Liang Xu, Guangdong (CN)

(72) Inventor: Liang Xu, Guangdong (CN)

( * ) Notice: Subject to any disclaimer, the term of this patent is extended or adjusted under 35 U.S.C. 154(b) by 1 day.

(21) Appl. No.: 18/123,965

(22) Filed: Mar. 20, 2023

(65) Prior Publication Data

US 2024/0158116 A1 May 16, 2024

(30) Foreign Application Priority Data

Nov. 11, 2022 (CN) ..... 202211414841.8

(51) Int. Cl.
*B65B 31/04* (2006.01)
*B65B 51/10* (2006.01)

(52) U.S. Cl.
CPC ..... *B65B 31/048* (2013.01); *B65B 51/10* (2013.01)

(58) Field of Classification Search
CPC ..... B65B 31/04; B65B 31/043; B65B 31/048; B65B 31/06; B65B 7/02; B65B 7/06; B65B 43/12; B65B 43/123; B65B 43/14; B65B 43/22; B65B 51/10; B65B 51/146; B29C 66/8322
See application file for complete search history.

(56) References Cited

U.S. PATENT DOCUMENTS 4,860,523 A * 8/1989 Teteishi ..... B65B 31/06 53/512
5,105,603 A * 4/1992 Natterer ..... B29C 66/53461 53/511
5,352,323 A * 10/1994 Chi ..... B65B 51/146 156/583.8
5,638,664 A * 6/1997 Levsen ..... B29C 65/222 53/512
6,047,522 A * 4/2000 Huang ..... B29C 66/43121 53/374.8
6,848,234 B2 * 2/2005 Sung ..... B65B 67/1227 53/284.7
6,862,867 B2 * 3/2005 Cady ..... B29C 66/43121 53/512
7,131,250 B2 * 11/2006 Kahn ..... B65B 51/146 53/434
7,131,251 B2 * 11/2006 Huang ..... B29C 66/8161 53/512
7,146,783 B2 * 12/2006 Levsen ..... B65B 31/046 53/512
7,204,067 B2 * 4/2007 Baptista ..... B65B 31/046 53/512

(Continued)

*Primary Examiner* — Dariush Seif

(57) ABSTRACT

The present invention relates to the technical field of sealing devices, for solving the technical problem that sealing and vacuumizing are incompatible when the sealing length of the bag is too long, and discloses a bag sealing machine, the machine head includes an upper bin, a roller for driving the bag to move and a heat generating module cooperating with the roller to seal the bag are arranged in the upper bin. An upper sealing ring is arranged at an outer side of a groove of the upper bin. A lower bin is arranged in the machine body, a vacuum hole is defined in the lower bin, and a lower sealing ring corresponding to the upper sealing ring is arranged at an outer side of a groove of the lower bin. A lifting mechanism for driving the lower bin to move up and down is provided in the machine body.

15 Claims, 7 Drawing Sheets

(56) References Cited

U.S. PATENT DOCUMENTS 7,377,087 B2 * 5/2008 Clarke ..... B65B 31/08 53/469
7,392,641 B2 * 7/2008 Abate ..... B65B 31/046 53/512
7,540,127 B2 * 6/2009 Sung ..... B65B 31/047 53/434
D608,803 S * 1/2010 Hageman ..... D15/146
8,726,960 B1 * 5/2014 Huang ..... B29C 66/133 156/359
9,021,771 B2 * 5/2015 Liu ..... B29C 66/91211 53/370.7
9,327,854 B2 * 5/2016 Huang ..... B65B 31/024
9,352,864 B2 * 5/2016 Hammad ..... B65B 31/024
9,422,073 B2 * 8/2016 Picozza ..... B65B 31/048
9,550,595 B2 * 1/2017 Steidele ..... B65B 31/024
9,676,506 B2 * 6/2017 Hammad ..... B65B 31/04
9,937,661 B2 * 4/2018 Chang ..... B29C 66/43121
10,858,129 B2 * 12/2020 Day ..... B65B 31/024
10,926,936 B2 * 2/2021 Kim ..... B65B 31/024
11,084,611 B2 * 8/2021 Thürig ..... B65B 31/024
11,299,309 B2 * 4/2022 Zhou ..... B65B 31/048
2004/0139701 A1 * 7/2004 Cady ..... B65B 31/024 53/434
2005/0022474 A1 * 2/2005 Albritton ..... B29C 66/8324 53/512
2005/0034427 A1 * 2/2005 Higer ..... B65B 31/046 53/477
2005/0205455 A1 * 9/2005 Harrison ..... B65D 33/01 206/524.8
2006/0254219 A1 * 11/2006 Alipour ..... B65D 81/2038 53/512
2010/0095638 A1 * 4/2010 Zakowski ..... B65B 31/046 53/511
2014/0116003 A1 * 5/2014 Hammad ..... B65B 7/06 53/376.3
2014/0150382 A1 * 6/2014 Yamada ..... B65B 57/02 53/510
2014/0165502 A1 * 6/2014 Wah ..... B29C 66/24245 53/329.2
2015/0027089 A1 * 1/2015 Owens ..... B29C 66/861 53/167
2015/0040517 A1 * 2/2015 Furuse ..... B65B 51/146 53/86
2015/0052850 A1 * 2/2015 Rausch ..... B65B 51/148 53/86
2015/0135641 A1 * 5/2015 Hu ..... B65B 31/024 53/86
2018/0079538 A1 * 3/2018 Hu ..... B65B 31/048
2021/0016910 A1 * 1/2021 Ye ..... B65B 31/048
2021/0053711 A1 * 2/2021 Kloeppel ..... B65B 51/32
2021/0179306 A1 * 6/2021 Zhou ..... B65B 61/26
2022/0144468 A1 * 5/2022 Schandel ..... B29C 65/224
2022/0152942 A1 * 5/2022 Kirmse ..... B29C 65/18
2022/0250779 A1 * 8/2022 Li ..... B65B 51/10
2022/0411118 A1 * 12/2022 Park ..... B29C 66/1122
2024/0101292 A1 * 3/2024 Zhou ..... B65B 31/046

* cited by examiner

BAG SEALING MACHINE

CROSS-REFERENCE TO RELATED APPLICATIONS

This application claims priority to Chinese Patent Application No. 202211414841.8 filed on Nov. 11, 2022, the entire contents of which are hereby incorporated by reference.

TECHNICAL FIELD

The present invention relates to the technical field of sealing devices, and particularly to a bag sealing machine.

BACKGROUND

In the existing bag sealing machines, the sealing length of the bag sealing machine with a vacuum function is constant, and the maximum sealing length is limited, whilst the bag sealing machine with variable sealing length does not have the vacuum function.

Chinese patent with the publication number of CN 209192338U discloses a vacuum hot sealing bag machine, which includes a machine body 1 and an upper cover 2. During in use, the bag is pressed between the machine body 1 and the upper cover 2, and then the opening of the bag is sealed after the air in the bag is extracted. The sealing length of this kind of bag sealing machine is constant and the maximum length is limited, so that it can only be used for bags within a specific length. When the length of the bag is too long, the bag sealing machine is not suitable and the application thereof is limited.

In order to solve the problem that the machine is unable to match the sealing length, Chinese patent with the publication number of CN 214730199U discloses a household portable mini sealing machine, which is described in paragraph as follows: "The user puts the plastic bag into the machine body 1, and then pushes the sealing mechanism 2 downwardly. The sealing mechanism 2 drives the fixing mechanism 3 to move downwardly until it comes into contact with the plastic bag, and thus the fixing mechanism 3 fixes the plastic bag. The sealing mechanism 2 continues to move downwards until it comes into contact with the plastic bag, and then the sealing mechanism 2 seals the plastic bag. After the plastic bag sealing is completed, the user stops pushing the sealing mechanism 2, the sealing mechanism 2 and the fixing mechanism 3 move upward by themselves to return to their original positions, and the plastic bag is then taken out from the machine body 1." Although this sealing machine is suitable for bags of different lengths, it cannot achieve the vacuum function and is operated manually. In order to realize vacuum function, a bag with an aperture for vacuumizing is required, and it is evacuated through the aperture after the bag is sealed, which puts forward higher requirements for the bag.

SUMMARY

In view of the shortcomings of the prior art, an object of the present invention is to provide a bag sealing machine to solve the technical problem that sealing and vacuumizing are incompatible when the sealing length of the bag is too long.

In order to achieve the above-mentioned object, a specific technical solution for the bag sealing machine of the present invention is as follows:

A bag sealing machine includes a machine head for hot melt sealing and a machine body for vacuum vacuumizing. The machine head includes an upper bin. A roller for driving the bag to move and a heat generating module cooperating with the roller to seal the bag are arranged in the upper bin. An upper sealing ring is arranged at an outer side of a groove of the upper bin. A lower bin is arranged in the machine body, a vacuum hole is defined in the lower bin, and a lower sealing ring corresponding to the upper sealing ring is arranged at an outer side of a groove of the lower bin. A lifting mechanism for driving the lower bin to move up and down is provided in the machine body. The bag is sent in through the roller mechanism, the heat generating module seals the opening of the bag through hot melt sealing, and the bag slides out when the hot melt sealing close to an end of the bag. At this time, a little of the opening of the bag is not yet sealed. The lower bin is driven to move upwardly by the lifting mechanism, so as to make the lower sealing ring arranged in the lower bin abut against the upper sealing ring to form a seal therebetween. A sealed chamber formed by the upper bin and the lower bin is vacuumized through the vacuum hole, and then the hot melt sealing is performed. After that, the lower bin moves downwardly and returns to its original position, and the bag is sent out through the roller mechanism. Through this bag sealing machine, the vacuumizing and sealing length may be unlimited in theory, that is, the length of the bag is not limited, so as to solve the technical problem that bag sealing and vacuumizing are incompatible when the sealing length of the bag is too long.

In some embodiments, a detection switch for detecting the bag is arranged between the machine head and the machine body. By means of the detecting of the detection switch, which may be a microswitch, a photoelectric switch or other switches, preferably a microswitch, automatic operation of sealing and vacuumizing is realized.

In some embodiments, a support plate extends downwardly from a lateral side of the groove of the upper bin, and the heat generating module is fixedly mounted to the support plate and arranged under the roller.

In some embodiments, the heat generating module includes a fixed housing fixed to the support plate, a bottom cover arranged at a bottom of the fixed housing, a heat transfer frame arranged in the fixed housing, and a heat generating element arranged in the heat transfer frame, a convex bar is provided on a top of the heat transfer frame, and a hole is defined in the fixed housing for avoiding the convex bar.

In some embodiments, a first motor for driving the roller to rotate is arranged at an outer side of the upper bin.

In some embodiments, the machine body includes an outer frame in which the lower bin and the lifting mechanism are arranged, and a side plate fixedly connected to the upper bin and the outer frame.

In some embodiments, a guiding strip for guiding the heat generating module is provided on an inner wall of the lower chamber, and an inner groove for receiving the lower sealing ring is defined in the lower bin.

In some embodiments, the outer frame is substantially U-shaped, and includes a first frame plate, two second frame plates fixedly connected to the left and right ends of the first frame plate, respectively, and position plates fixedly connected to the top and bottom ends of each second frame plate, respectively, and position holes are defined in the position plates.

In some embodiments, the lifting mechanism includes a bottom plate connected to a bottom of the outer frame and a lifting plate arranged on the bottom plate, flanges extend horizontally from two sides of the lower bin to two ends, respectively, each flange is provided with guiding sleeves and guiding columns which extend through the lifting plate and the guiding sleeves, a spring is mounted around the guiding column, and two ends of the guiding column are arranged in the position holes, respectively.

In some embodiments, a nut seat is fixedly arranged on the lifting plate, a screw rod is arranged in the nut seat, and a second motor for driving the screw rod to rotate is arranged under the bottom plate.

In some embodiments, an external heating module is embedded in the outer side of the groove of the upper bin and located at an outer side of the upper sealing ring, and a pressure-sealing arm cooperating with the external heating module is embedded in the lower bin.

The bag sealing machine provided by the invention has the following advantages:

The bag is sent in through the roller mechanism, the heat generating module seals the opening of the bag through hot melt sealing, and the bag slides out when the hot melt sealing close to an end of the bag. At this time, a little of the opening of the bag is not yet sealed. The lower bin is driven to move upwardly by the lifting mechanism, so as to make the lower sealing ring arranged in the lower bin abut against the upper sealing ring to form a seal therebetween. A sealed chamber formed by the upper bin and the lower bin is vacuumized through the vacuum hole, and then the hot melt sealing is performed. After that, the lower bin moves downwardly and returns to its original position, and the bag is sent out through the roller mechanism. In addition, by means of the detecting of the detection switch, automatic operation of sealing and vacuumizing is realized. Through this bag sealing machine, the vacuumizing and sealing length may be unlimited in theory, that is, the length of the bag is not limited, so as to solve the technical problem that bag sealing and vacuumizing are incompatible when the sealing length of the bag is too long.

LIST OF REFERENCE NUMERALS

Figure 1:
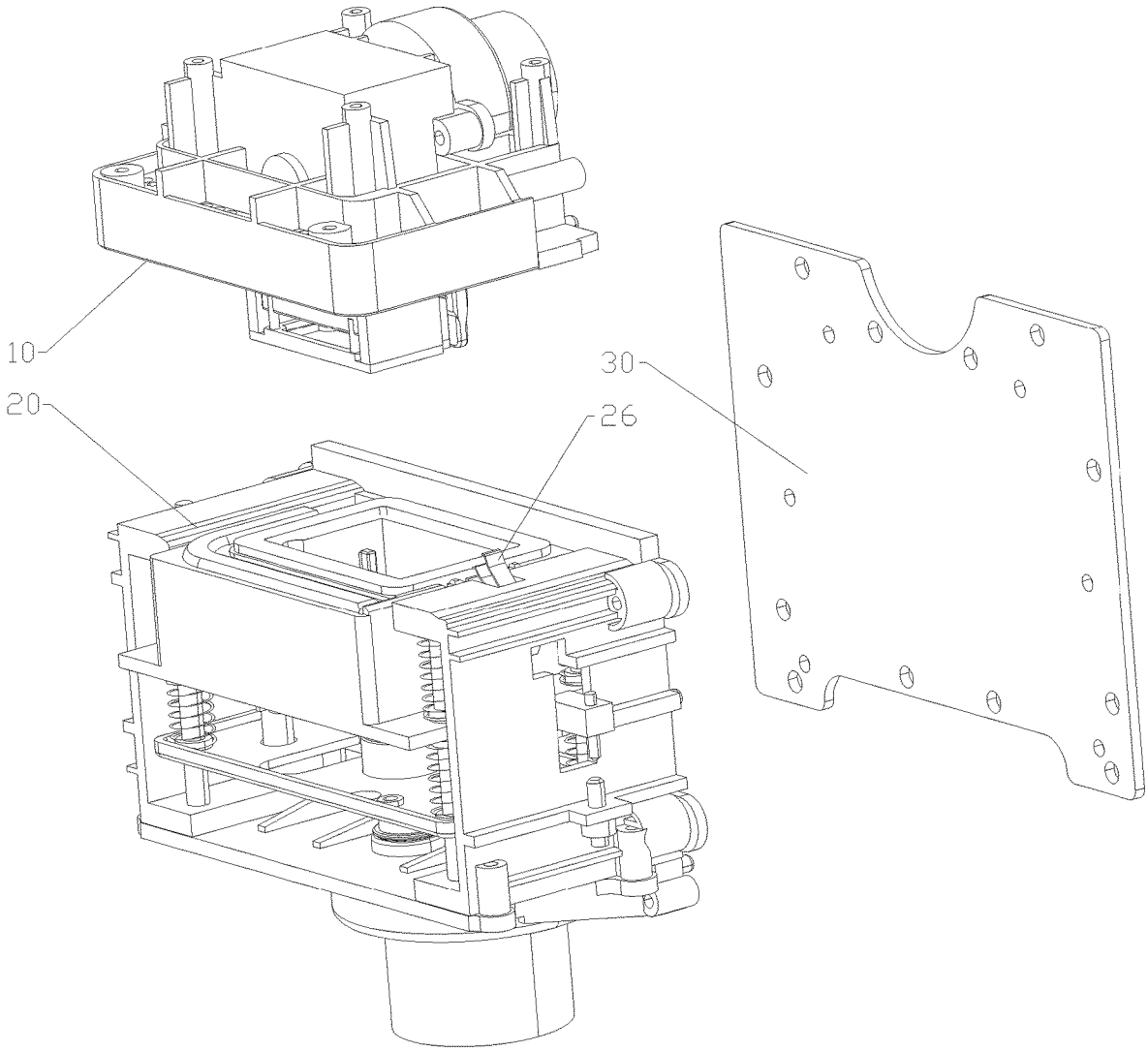
FIG. 1 is a schematic, exploded view of a bag sealing machine provided by the present invention.

10 machine head
20 machine body
30 side plate
11 upper bin
12 roller mechanism
13 bottom cover
14 heat generating element
15 heat transfer frame
16 fixed housing
17 upper sealing ring
18 external heating module
111 first groove
112 support plate
113 annular groove
114 L-shaped groove
121 roller
122 first motor
161 hole
21 outer frame
22 lower bin
23 lifting plate
24 bottom plate
25 second motor
26 microswitch
27 wire clamp
28 lower sealing ring
29 pressure-sealing arm
211 first frame plate
212 second frame plate
213 position plate
214 aperture
215 mounting plate
221 second groove
222 inner groove
223 outer groove
224 wire-passing hole
225 vacuum hole
226 guiding strip
227 flange
228 guiding sleeve
231 guiding column
232 spring
233 nut seat
234 screw rod

DESCRIPTION OF THE EMBODIMENTS

For better illustrating the technical means, creative features, objects and effects of the present invention, detailed description will be given for the embodiments provided by the present invention with reference to the append drawings. It should be understood that the specific embodiments described here are only used to explain the present invention, not to restrict the present invention.

Referring to FIG. 1, the present invention provides a bag sealing machine, including a machine head 10 for hot melt sealing and a machine body 20 for vacuumizing. The machine head 10 and the machine body 20 are fixedly mounted to a side plate 30, and a gate for entering or exiting of the bag is defined between the machine head 10 and the machine body 20. A microswitch 26 is provided between the machine head 10 and the machine body 20 for detecting the entering state or exiting state of the bag.

Figure 2:
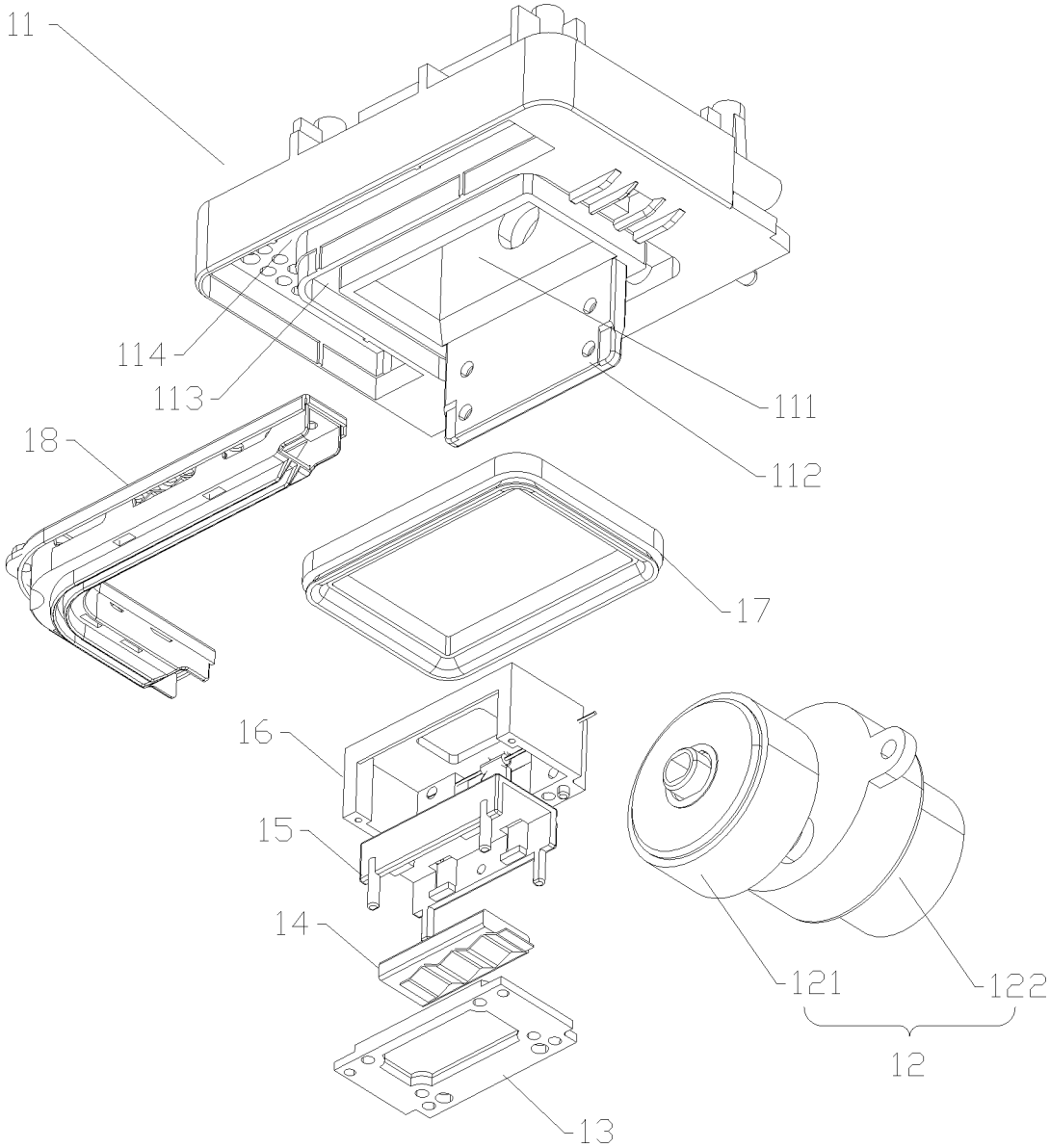
FIG. 2 is an exploded view of a handpiece provided by the present invention, viewed from a first aspect.
Figure 3:
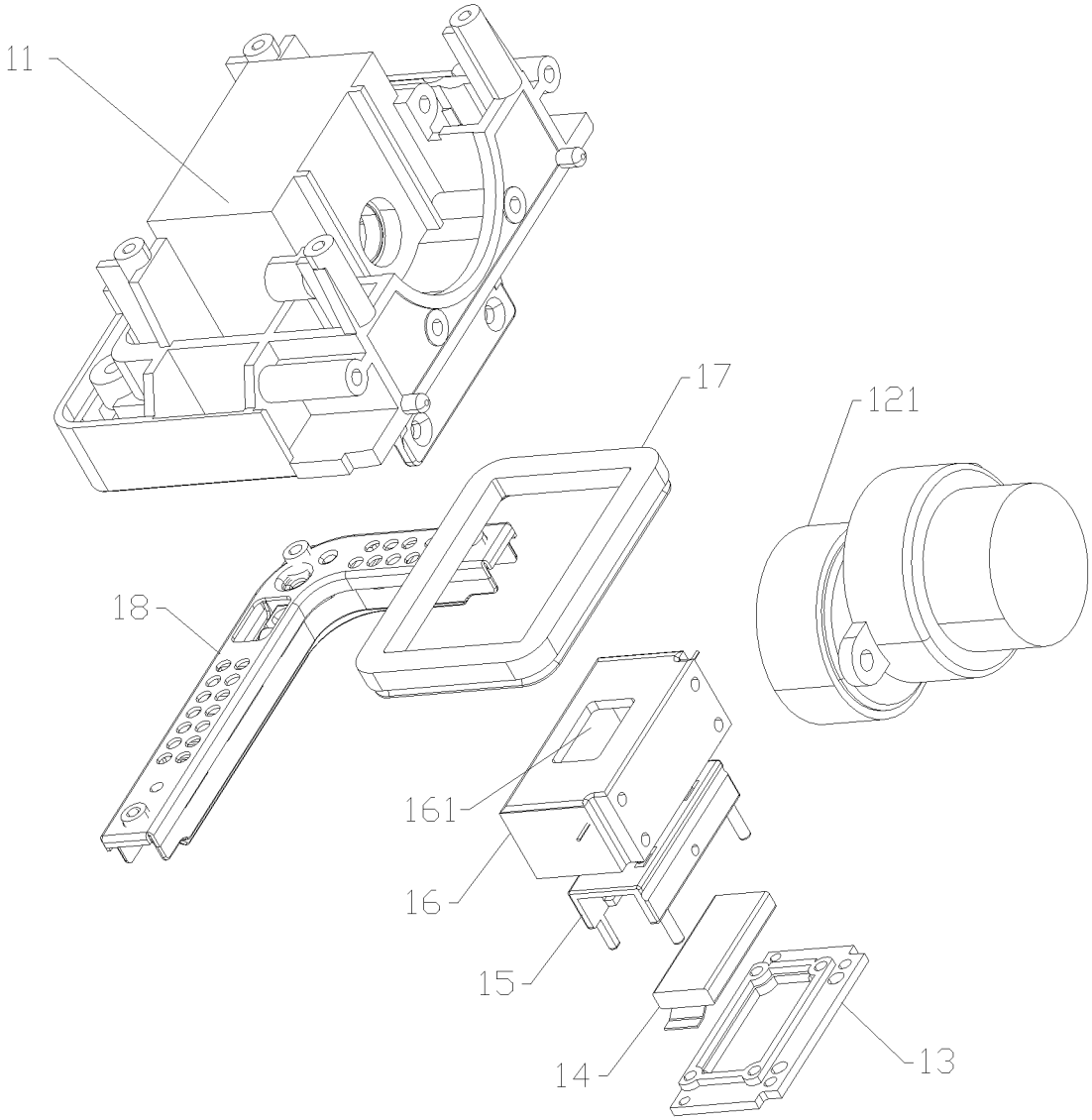
FIG. 3 is an exploded view of the handpiece provided by the present invention, viewed from a second aspect.

Referring to FIG. 2 and FIG. 3, the machine head 10 includes an upper bin 11, a heat generating module and a roller mechanism 12. The roller mechanism 12 includes a roller 121 and a first motor 122 for driving the roller 121 to rotate. A first groove 111 is defined in the upper bin 11, and the roller 121 is arranged in the first groove 111. A support plate 112 extends vertically and downwardly from a lateral side of the groove. The heat generating module is fixedly mounted to the support plate 112, and is arranged under the roller 121. An outer side of the groove of the upper bin 11 is provided with an upper sealing ring 17.

Figure 4:
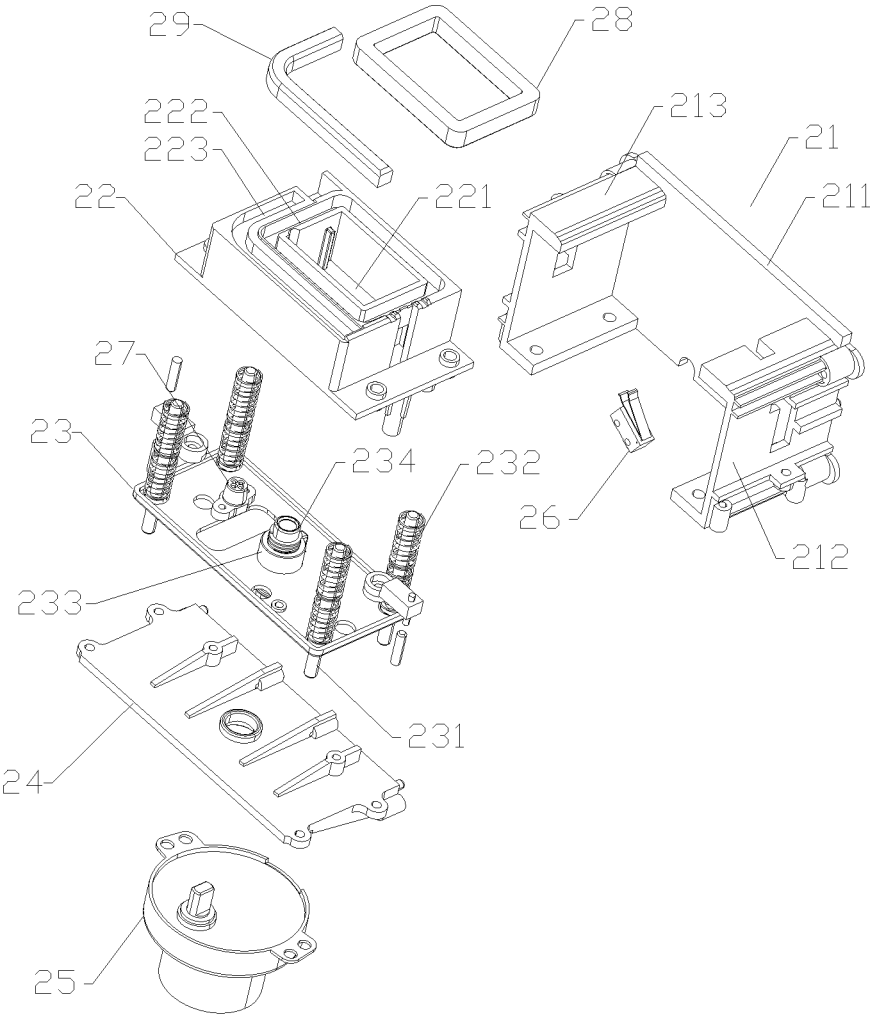
FIG. 4 is an exploded view of a machine body provided by the present invention, viewed from a first aspect.
Figure 5:
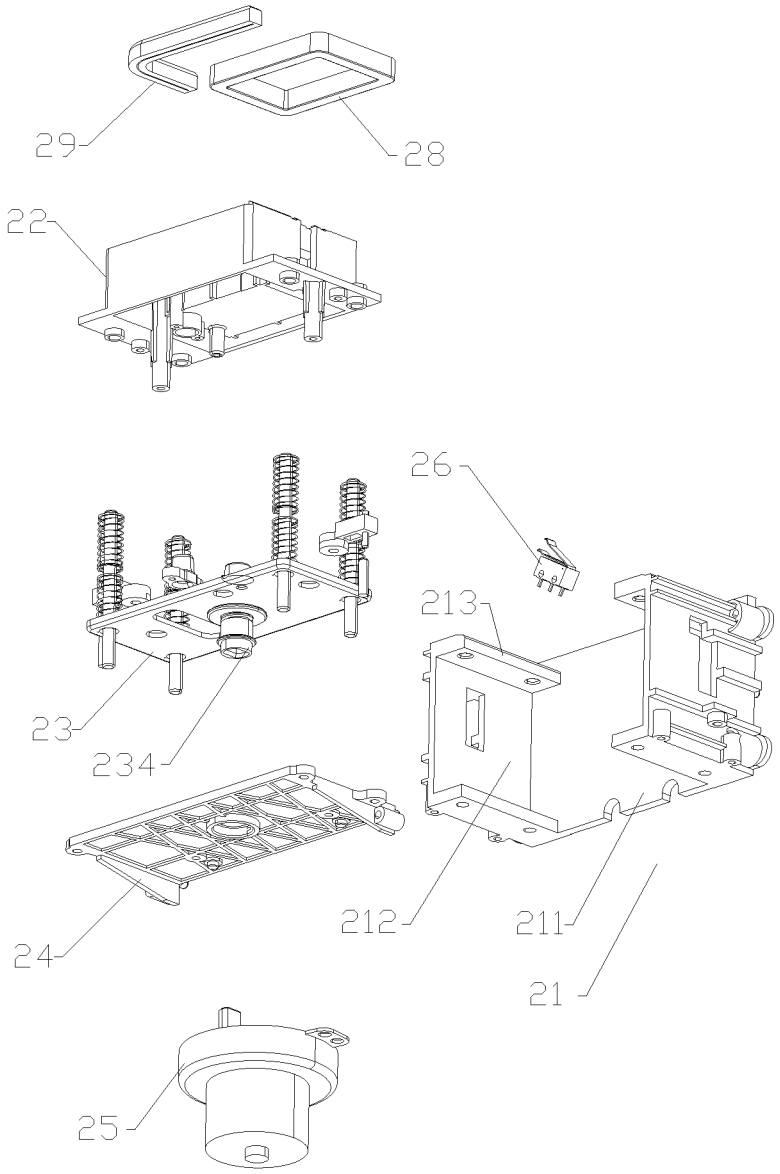
FIG. 5 is an exploded view of the machine body provided by the present invention, viewed from a second aspect.
Figure 6:
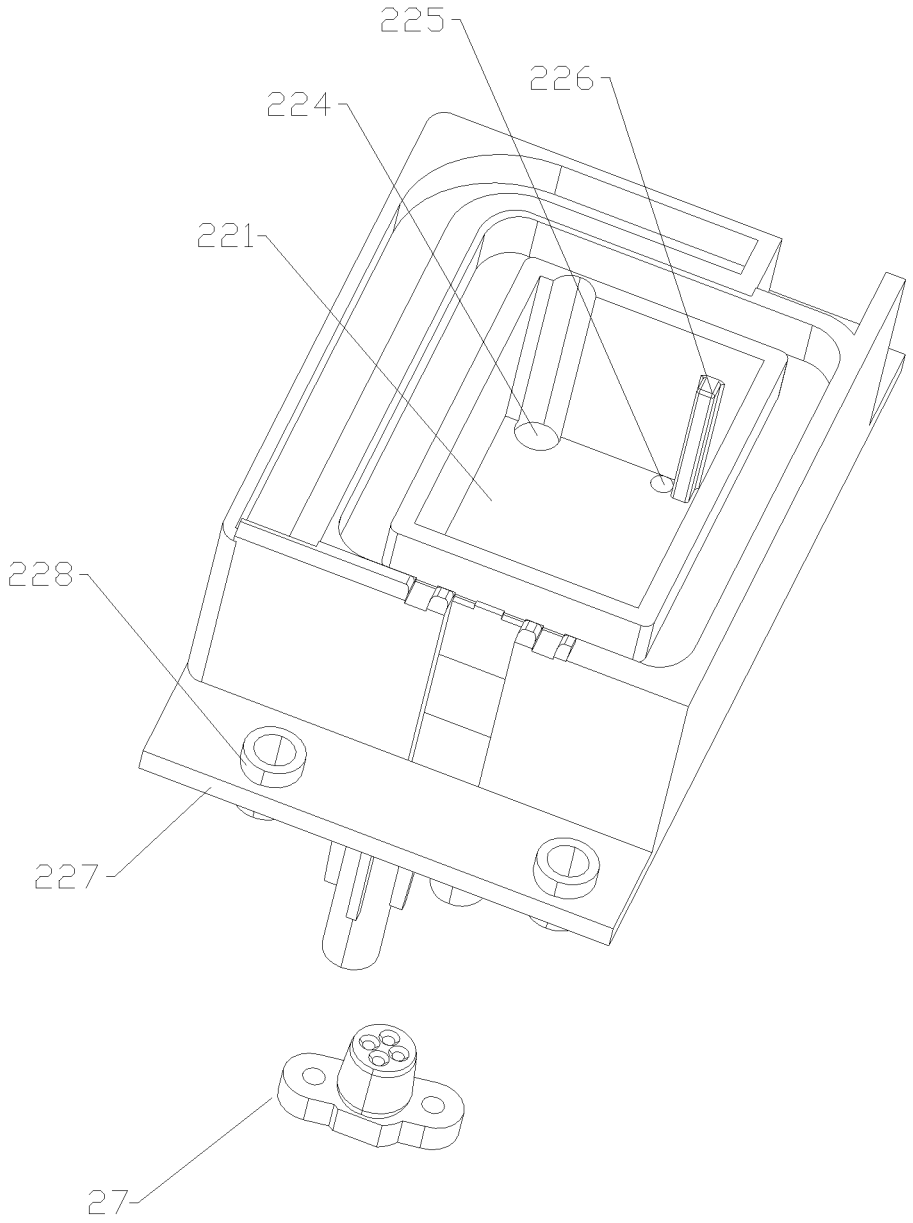
FIG. 6 is a schematic view of a lower chamber provided by the present invention.

Referring to FIG. 4 to FIG. 6, a lower bin 22 is provided in the machine body 20 with a second groove 211 defined therein. A vacuum hole 225 is defined in the second groove 211 and communicates with the outside. A wire-passing hole 224 for extending of wires is defined in the second groove 211 and communicates with the outside. A wire clamp 27 is provided in the wire-passing hole 224 for sealing the wire-passing hole 224. A lower sealing ring 28 corresponding to the upper sealing ring 17 is provided on outer side of the second groove 211 of the lower bin 22. The machine body 20 is further provided with a lifting mechanism for driving the lower bin 22 to move up and down.

The bag is sent in through the roller mechanism 12 and slides in from a position where the microswitch 26 is arranged. The heat generating module seals the opening of the bag through hot melt sealing, and the bag slides out from the position where the microswitch 26 is arranged when the hot melt sealing close to an end of the bag. At this time, a little of the opening of the bag is not yet sealed. The lower bin 22 is driven to move upwardly by the lifting mechanism, so as to make the lower sealing ring 28 arranged in the lower bin 22 abut against the upper sealing ring 17 to form a seal therebetween. A sealed chamber formed by the upper bin 11 and the lower bin 22 is vacuumized through the vacuum hole 225, and then the hot melt sealing is performed. After that, the lower bin 22 moves downwardly and returns to its original position, and the bag is sent out through the roller mechanism 12. Through this bag sealing machine, the vacuumizing and sealing length may be unlimited in theory, that is, the length of the bag is not limited, so as to solve the technical problem that bag sealing and vacuumizing are incompatible when the sealing length of the bag is too long.

Automatic detection may be realized through the microswitch 26, which is faster and more accurate than manual judgment.

Specifically, referring to FIG. 2 and FIG. 3, the heat generating module includes a housing 16 fixed to the support plate 112, a bottom cover 13 arranged at a bottom of the fixed housing 16, a heat transfer frame 15 arranged in the fixed housing 16, and a heat generating element 14 arranged in the heat transfer frame 15. An arc-shaped convex bar is provided on a top of the heat transfer frame 15, and a hole 161 is defined in the fixed housing 16 for avoiding the convex bar. The roller 121 and the convex bar are used to clamp the bag. When the heat generating element 14 is heated, the heat is transferred to the convex bar for melting the bag, thereby achieving the sealing effect.

A slot is defined at an outer side of the heat transfer frame 15, and a temperature sensor is arranged in the slot for obtaining the sealing temperature in real time and realizing temperature control. The heat transfer frame 15 is provided with positioning feet, through which the heat transfer frame 15 is positioned on the bottom cover 13. The fixed housing 16 is connected to the bottom cover 13 through screws. The fixed housing 16 and support plate 112 are respectively provided with screw holes, and are fixedly connected by screws.

In an embodiment, the first motor 122 is installed out of the upper bin 11, and a motor shaft of the first motor 122 is connected to the roller 121.

At an outer periphery of the first groove 111 of the upper chamber 11, an annular groove 113 and an L-shaped groove 114 are arranged from the inside to the outside. The upper sealing ring 17 is embedded in the annular groove 113, and the thickness of the upper sealing ring 17 is greater than the depth of the annular groove 113. An external heating module 18 is arranged in the L-shaped groove 114, and includes an L-shaped upper cover and a lower cover. A bottom of the lower cover is provided with a strip-shaped protrusion. The lower cover has a heat conduction function. A heating member is arranged between the upper cover and the lower cover. The heating member transfers the heat to the strip-shaped protrusion.

Referring to FIG. 4 and FIG. 5, the machine body 20 includes an outer frame 21, and the lower bin 22 and the lifting mechanism are arranged in the outer frame 21. A guiding strip 226 for guiding the heat generating module is provided on an inner wall of the second groove 211 of the lower chamber 22. The lower bin 22 is provided with an inner groove 222 for receiving the lower sealing ring 28, and the inner groove 222 is annular and at an outer periphery of the second groove 211.

An outer side of the inner groove 222 is provided with an outer groove 223. A pressure-sealing arm 29 cooperating with the outer heat generating module 18 is arranged in the outer groove 223. The external heating module 18 and the pressure-sealing arm 29 construct a second hot-sealing mechanism of the bag sealing machine, which enriches the product functions and expands the product application scenarios.

Figure 7:
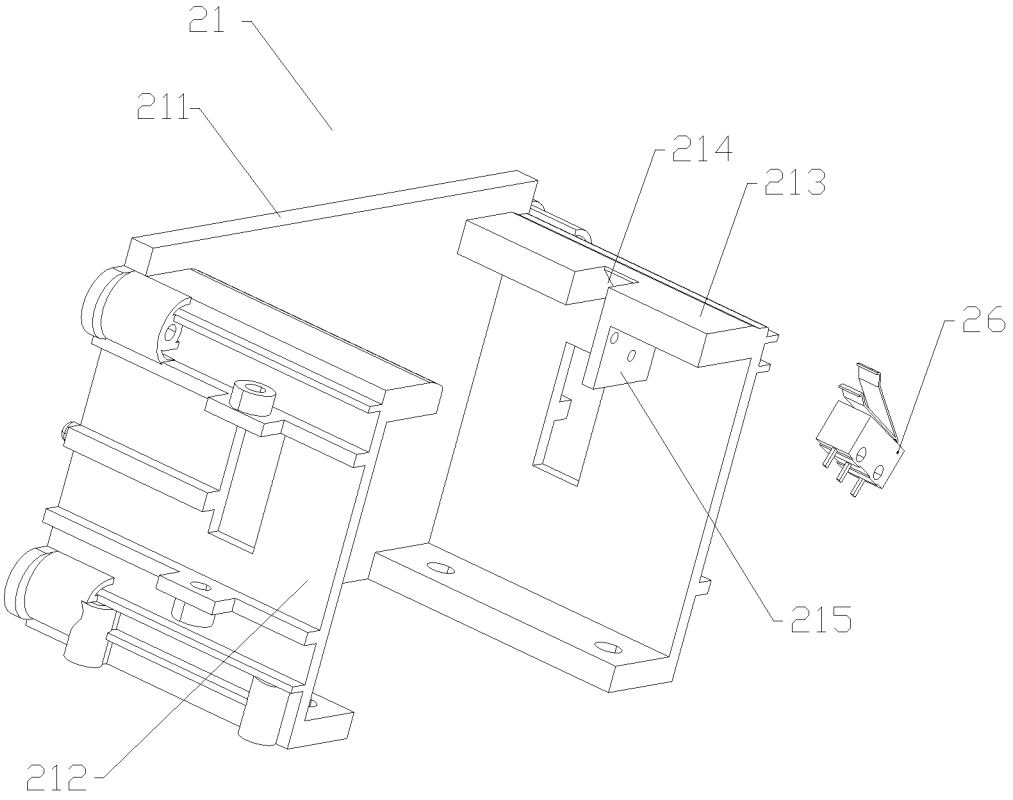
FIG. 7 is a schematic view of an outer frame provided by the present invention.

Referring to FIG. 7, the outer frame 21 is generally U-shaped, and includes a first frame plate 211, two second frame plates 212 fixedly connected to the left and right ends of the first frame plate 211, respectively, and position plates 213 fixedly connected to the top and bottom ends of each second frame plate, respectively. Position holes are defined in the position plates 213. An aperture 214 is defined in one of the position plates 213 which is located at the top of one side, and a mounting plate 215 is arranged under the aperture 214 and connected to the position plate 213. The microswitch 26 is arranged on the mounting plate 215, and has an elastic sheet engaged into the aperture 214. Position limit structures are provided on corresponding positions of the upper bin 11 and the lower bin 22 for the microswitch 26.

Refer to FIG. 4 to FIG. 6, the lifting mechanism includes a bottom plate 24 connected to a bottom of the outer frame 21 and a lifting plate 23 arranged on the bottom plate 24. Flanges 227 extend horizontally from two sides of the lower bin 22 to two ends, respectively. Each flange 227 is provided with guiding sleeves 228 and guiding columns 231 which extend through the lifting plate 23 and the guiding sleeves 228. A spring 232 is mounted around the guiding column 231, and two ends of the guiding column 231 are arranged in the position holes, respectively.

A nut seat 233 is fixedly arranged on the lifting plate 23, and a screw rod 234 is arranged in the nut seat 233. A second motor 25 for driving the screw rod 234 to rotate is arranged under the bottom plate 24.

The second motor 25 drives the screw rod 234 to rotate, which cooperates with the nut seat 233 to drive the lifting plate 23 to move up and down. The lifting plate 23 lifts the lower bin 22 through the spring 232. On the contrary, when the lifting plate 23 moves downwardly, the lower bin 22 moves downwardly under the reset action of the spring 232.

In summary, the present invention provides a bag sealing machine that: the bag is sent in through the roller mechanism and slides in from a position where the microswitch is arranged, the heat generating module seals the opening of the bag through hot melt sealing, and the bag slides out from the position where the microswitch is arranged when the hot melt sealing close to an end of the bag. At this time, a little of the opening of the bag is not yet sealed. The lower bin is driven to move upwardly by the lifting mechanism, so as to make the lower sealing ring arranged in the lower bin abut against the upper sealing ring to form a seal therebetween. A sealed chamber formed by the upper bin and the lower bin is vacuumized through the vacuum hole, and then the hot melt sealing is performed. After that, the lower bin moves downwardly and returns to its original position, and the bag is sent out through the roller mechanism. Through this bag sealing machine, the vacuumizing and sealing length may be unlimited in theory, that is, the length of the bag is not limited, so as to solve the technical problem that bag sealing and vacuumizing are incompatible when the sealing length of the bag is too long.

The above merely provides the preferred embodiments of the present invention, which is illustrative, rather than restrictive, to the present invention. However, it should be understood by those skilled in the art that, many variations, modifications even substitutions that do not depart from the spirit and scope defined by the present invention, shall fall into the extent of protection of the present invention.

What is claimed is:

1. A bag sealing machine comprising a machine head (10) for hot melt sealing and a machine body (20) for vacuum vacuumizing, the machine head (10) comprising an upper bin (11), a roller (121) for driving the bag to move and a heat generating module cooperating with the roller (121) to seal the bag being arranged in the upper bin (11), an upper sealing ring (17) being arranged at an outer side of a groove of the upper bin (11);

a lower bin (22) being arranged in the machine body (20), a vacuum hole (225) being defined in the lower bin (22), a lower sealing ring (28) corresponding to the upper sealing ring (17) being arranged at an outer side of a groove of the lower bin (22), and a lifting mechanism for driving the lower bin (22) to move up and down being provided in the machine body (20);

wherein a detection switch for detecting the bag is arranged between the machine head (10) and the machine body (20).

2. The bag sealing machine according to claim 1, wherein a support plate (112) extends downwardly from a lateral side of the groove of the upper bin (11), and the heat generating module is fixedly mounted to the support plate (112) and arranged under the roller (121).

3. The bag sealing machine according to claim 2, wherein the heat generating module comprises a fixed housing (16) fixed to the support plate (112), a bottom cover (13) arranged at a bottom of the fixed housing (16), a heat transfer frame (15) arranged in the fixed housing (16), and a heat generating element (14) arranged in the heat transfer frame (15), a convex bar is provided on a top of the heat transfer frame (15), and a hole (161) is defined in the fixed housing (16) for avoiding the convex bar.

4. The bag sealing machine according to claim 1, wherein the machine body (20) comprises an outer frame (21), and the lower bin (22) and the lifting mechanism are arranged in the outer frame (21), and wherein further comprises a side plate (30) fixedly connected to the upper bin (11) and the outer frame (21).

5. The bag sealing machine according to claim 4, wherein a guiding strip (226) for guiding the heat generating module is provided on an inner wall of the lower chamber (22), and an inner groove (222) for receiving the lower sealing ring (28) is defined in the lower bin (22).

6. The bag sealing machine according to claim 5, wherein the outer frame (21) is substantially U-shaped, and comprises a first frame plate (211), two second frame plates (212) fixedly connected to the left and right ends of the first frame plate (211), respectively, and position plates (213) fixedly connected to the top and bottom ends of each second frame plate (212), respectively, and position holes are defined in the position plates (213).

7. The bag sealing machine according to claim 6, wherein the lifting mechanism comprises a bottom plate (24) connected to a bottom of the outer frame (21) and a lifting plate (23) arranged on the bottom plate (24), flanges (227) extend horizontally from two sides of the lower bin (22) to two ends, respectively, each flange 227 is provided with guiding sleeves (228) and guiding columns (231) which extend through the lifting plate (23) and the guiding sleeves (228), a spring (232) is mounted around the guiding column (231), and two ends of the guiding column (231) are arranged in the position holes, respectively.

8. The bag sealing machine according to claim 7, wherein a nut seat (233) is fixedly arranged on the lifting plate (23), a screw rod (234) is arranged in the nut seat (233), and a second motor (25) for driving the screw rod (234) to rotate is arranged under the bottom plate (24).

9. The bag sealing machine according to claim 1, wherein an external heating module (18) is embedded in the outer side of the groove of the upper bin (11) and located at an outer side of the upper sealing ring (17), and a pressure-sealing arm (29) cooperating with the external heating module (18) is embedded in the lower bin (22).

10. A bag sealing machine comprising a machine head (10) for hot melt sealing and a machine body (20) for vacuum vacuumizing, the machine head (10) comprising an upper bin (11), a roller (121) for driving the bag to move and a heat generating module cooperating with the roller (121) to seal the bag being arranged in the upper bin (11), an upper sealing ring (17) being arranged at an outer side of a groove of the upper bin (11);

a lower bin (22) being arranged in the machine body (20), a vacuum hole (225) being defined in the lower bin (22), a lower sealing ring (28) corresponding to the upper sealing ring (17) being arranged at an outer side of a groove of the lower bin (22), and a lifting mechanism for driving the lower bin (22) to move up and down being provided in the machine body (20);

wherein the machine body (20) comprises an outer frame (21), and the lower bin (22) and the lifting mechanism are arranged in the outer frame (21), and wherein further comprises a side plate (30) fixedly connected to the upper bin (11) and the outer frame (21).

11. The bag sealing machine according to claim 10, wherein a guiding strip (226) for guiding the heat generating module is provided on an inner wall of the lower chamber (22), and an inner groove (222) for receiving the lower sealing ring (28) is defined in the lower bin (22).

12. The bag sealing machine according to claim 11, wherein the outer frame (21) is substantially U-shaped, and comprises a first frame plate (211), two second frame plates (212) fixedly connected to the left and right ends of the first frame plate (211), respectively, and position plates (213) fixedly connected to the top and bottom ends of each second frame plate (212), respectively, and position holes are defined in the position plates (213).

13. The bag sealing machine according to claim 12, wherein the lifting mechanism comprises a bottom plate (24) connected to a bottom of the outer frame (21) and a lifting plate (23) arranged on the bottom plate (24), flanges (227) extend horizontally from two sides of the lower bin (22) to two ends, respectively, each flange 227 is provided with guiding sleeves (228) and guiding columns (231) which extend through the lifting plate (23) and the guiding sleeves (228), a spring (232) is mounted around the guiding column (231), and two ends of the guiding column (231) are arranged in the position holes, respectively.

14. The bag sealing machine according to claim 13, wherein a nut seat (233) is fixedly arranged on the lifting plate (23), a screw rod (234) is arranged in the nut seat (233), and a second motor (25) for driving the screw rod (234) to rotate is arranged under the bottom plate (24).

15. A bag sealing machine comprising a machine head (10) for hot melt sealing and a machine body (20) for vacuum vacuumizing, the machine head (10) comprising an upper bin (11), a roller (121) for driving the bag to move and a heat generating module cooperating with the roller (121) to seal the bag being arranged in the upper bin (11), an upper sealing ring (17) being arranged at an outer side of a groove of the upper bin (11);

a lower bin (22) being arranged in the machine body (20), a vacuum hole (225) being defined in the lower bin (22), a lower sealing ring (28) corresponding to the upper sealing ring (17) being arranged at an outer side of a groove of the lower bin (22), and a lifting mechanism for driving the lower bin (22) to move up and down being provided in the machine body (20);

wherein an external heating module (18) is embedded in the outer side of the groove of the upper bin (11) and located at an outer side of the upper sealing ring (17), and a pressure-sealing arm (29) cooperating with the external heating module (18) is embedded in the lower bin (22).

* * * * *